US009679718B2

(12) United States Patent
Kubisiak

(10) Patent No.: US 9,679,718 B2
(45) Date of Patent: Jun. 13, 2017

(54) KNIFE SWITCH SAFETY DEVICE

(71) Applicant: Huntington Ingalls Incorporated, Newport News, VA (US)

(72) Inventor: Kelly R. Kubisiak, Newport News, VA (US)

(73) Assignee: Huntington Ingalls Incorporated, Newport News, VA (US)

( * ) Notice: Subject to any disclaimer, the term of this patent is extended or adjusted under 35 U.S.C. 154(b) by 6 days.

(21) Appl. No.: 14/828,877

(22) Filed: Aug. 18, 2015

(65) Prior Publication Data

US 2016/0055995 A1 Feb. 25, 2016

Related U.S. Application Data

(60) Provisional application No. 62/070,268, filed on Aug. 19, 2014.

(51) Int. Cl.

| | |
|---|---|
| ***H01H 9/28*** | (2006.01) |
| ***H01H 21/54*** | (2006.01) |
| ***H01H 9/16*** | (2006.01) |
| ***H01H 1/42*** | (2006.01) |

(52) U.S. Cl.

CPC ..... *H01H 21/54* (2013.01); *H01H 1/42* (2013.01); *H01H 9/16* (2013.01); *H01H 9/28* (2013.01)

(58) Field of Classification Search

CPC H01H 21/54; H01H 1/42; H01H 9/28; H01H 9/16

USPC ..... 200/43.01, 43.11, 43.13, 43.16, 43.19, 200/43.21

See application file for complete search history.

(56) References Cited

U.S. PATENT DOCUMENTS

| | | | | |
|---|---|---|---|---|
| 3,997,749 | A * | 12/1976 | Hanagan | H01H 1/42 200/318.1 |
| 5,341,269 | A | 8/1994 | Hayward et al. | |
| 5,969,308 | A | 10/1999 | Pever | |
| 6,365,851 | B1 * | 4/2002 | Gasper | H01H 9/08 200/43.14 |
| 6,580,041 | B1 * | 6/2003 | Ransopher | H01H 9/286 200/43.11 |

(Continued)

OTHER PUBLICATIONS

International Search Report and the Written Opinion of the International Searching Authority issued in in PCTIUS2015/045645, mailed Nov. 24, 2015.

(Continued)

*Primary Examiner* — Renee Luebke
*Assistant Examiner* — Lheiren Mae A Caroc
(74) *Attorney, Agent, or Firm* — Hunton & Williams LLP

(57) ABSTRACT

A safety device is provided for use in conjunction with a knife switch disposed in a switch well. The safety device comprises an elongate base member having a head end and an insertion portion extending distally away therefrom. The insertion portion is configured for at least partial insertion into the switch well between the knife switch and an internal wall of the switch well when the knife switch is in its open configuration. The device further comprises a slot formed in at least a portion of the insertion portion of the base member. The slot is sized and positioned to receive at least a portion of the blade when the knife switch is in its open configuration and the insertion portion is inserted into the switch well between the knife switch and the internal wall.

20 Claims, 8 Drawing Sheets

(56) References Cited

U.S. PATENT DOCUMENTS

| | | | |
|---|---|---|---|
| 2014/0097154 | A1 | 4/2014 | Uitto et al. |
| 2014/0220802 | A1 | 8/2014 | Elsesser et al. |

OTHER PUBLICATIONS

U.S. Navy's Tag-Out Users Manual, NAVSEA S0400-AD-URM-010/TUM, Nov. 21, 2013, 91 pgs.

* cited by examiner

KNIFE SWITCH SAFETY DEVICE

CROSS-REFERENCE TO RELATED APPLICATION

This application claims priority to U.S. Provisional Application No. 62/070,268, filed Aug. 19, 2014, the complete disclosure of which is incorporated herein by reference in its entirety.

BACKGROUND OF THE INVENTION

The present invention relates generally to protective hardware for electrical systems and more particularly to a safety device for tagging and preventing closure of a knife switch in a terminal block.

Lockout and tagout (LOTO) procedures are used in industry and other operational settings to ensure that machinery and electrical circuits are shut off or isolated to facilitate safe maintenance, grooming, testing troubleshooting and other servicing work. It requires that power sources to a system or machine be isolated or rendered inoperative before any procedure is conducted on the system or machine. Ideally, a LOTO procedure includes measures for (1) assuring that the system or machine cannot be accidentally or inadvertently reconnected to its power source(s) (the "lock-out" function) and (2) providing readily apparent visual or other evidence of the unpowered status of the system or machine and/or the device used to accomplish this status (the "tag-out" function).

Some systems, however may not lend themselves to a lock-out function because the switches used to isolate circuitry cannot be easily locked in their unpowered positions. This leads to the undesirable situation where safety would have to depend entirely on tag-out procedures.

In most operational settings, LOTO procedures are required to meet government safety standards. In the civilian arena these are typically established by OSHA. In the military setting, the standards and procedures may be set by the service branches. See, e.g., the U.S. Navy's Tag-Out Users Manual, NAVSEA 50400-AD-URM-010/TUM Rev. 6 ("Navy TUM"), which sets forth Navy requirements and is incorporated herein by reference in its entirety. Such requirements will often discourage or prohibit tag-out-only safety procedures as in the following Navy requirements:

4.c. . . . A Danger tagged switch shall not normally be used for electrical isolation or as a single means for preventing operation. If the circuit requiring isolation cannot be de-energized by other means, e.g., opening circuit breakers or removing fuses, without significantly affecting current operational requirements, a tagged switch may be used except as prohibited in paragraph 4.c.(1). In addition to danger tagging required circuit breakers and/or fuse holders, tags may also be attached to a switch to indicate that the associated circuit is danger tagged, and to prevent inadvertent operation of that switch.

(1) Use of a tagged switch for electrical isolation or as a single means for preventing operation is expressly prohibited in the following cases:

(a) The switch's physical location makes it subject to inadvertent operation.

Navy TUM, Appendix F, Sec. 4.c

SUMMARY OF THE INVENTION

An illustrative aspect of the invention provides a safety device for use in conjunction with a knife switch at least partially disposed in a switch well. The knife switch has a conductive blade and is rotatable between a closed configuration in which the blade engages an electrical contact in the switch well and an open configuration in which the blade is spaced apart from the electrical contact. The safety device comprises an elongate base member having a head end and an insertion portion extending distally away therefrom. The insertion portion is configured for at least partial insertion into the switch well between the knife switch and an internal wall of the switch well when the knife switch is in its open configuration. The device further comprises a slot formed in at least a portion of the insertion portion of the base member. The slot is sized and positioned to receive at least a portion of the blade when the knife switch is in its open configuration and the insertion portion is inserted into the switch well between the knife switch and the internal wall. The device also comprises a head attached to the base member at its head end.

Another illustrative aspect of the invention provides a method of using a safety device in conjunction with a knife switch at least partially disposed in a switch well having internal walls and a floor. The knife switch has a conductive blade and is rotatable between a closed configuration in which the blade engages an electrical contact in the switch well and an open configuration in which the blade is spaced apart from the electrical contact. The method comprises providing a safety device having an elongate base member having a head end and an insertion portion extending distally away therefrom. A slot is formed in at least a portion of the insertion portion of the base member and a head is attached to the base member at its head end. The method further comprises rotating the knife switch from the closed position to the open position and inserting the base member insertion portion of the safety device into the switch well. The insertion portion is inserted so that it is between the knife switch and an internal wall of the switch well so that the knife switch is prevented from rotating back to the closed configuration.

BRIEF DESCRIPTION OF THE DRAWINGS

The invention can be more fully understood by reading the following detailed description together with the accompanying drawings, in which like reference indicators are used to designate like elements, and in which.

DETAILED DESCRIPTION OF THE INVENTION

The present invention provides a safety device for use in conjunction with a terminal block configured with a knife switch for making or breaking a circuit. The safety device of the invention provides a simple mechanism for preventing closure of an open switch (lock-out function) and for providing a readily visible indicator that the switch is open (Tag-out function).

While the invention will be described in connection with particular embodiments, it will be understood that the invention is not limited to these embodiments. On the contrary, it is contemplated that various alternatives, modifications and equivalents are included within the spirit and scope of the invention as described.

Figure 1:
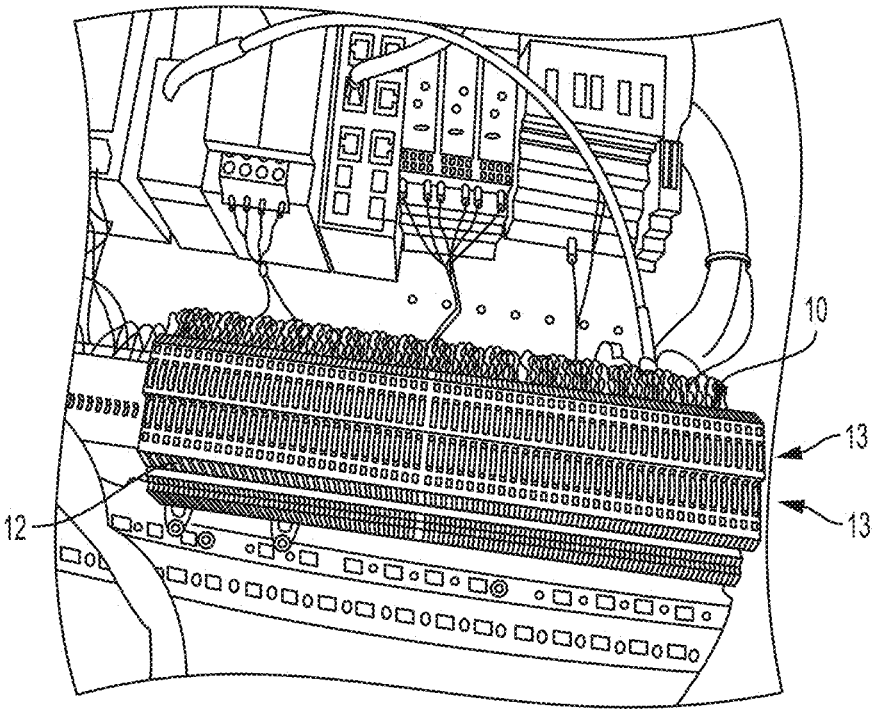
FIG. 1 is a photograph of a gang of double stack terminal blocks.
Figure 2:
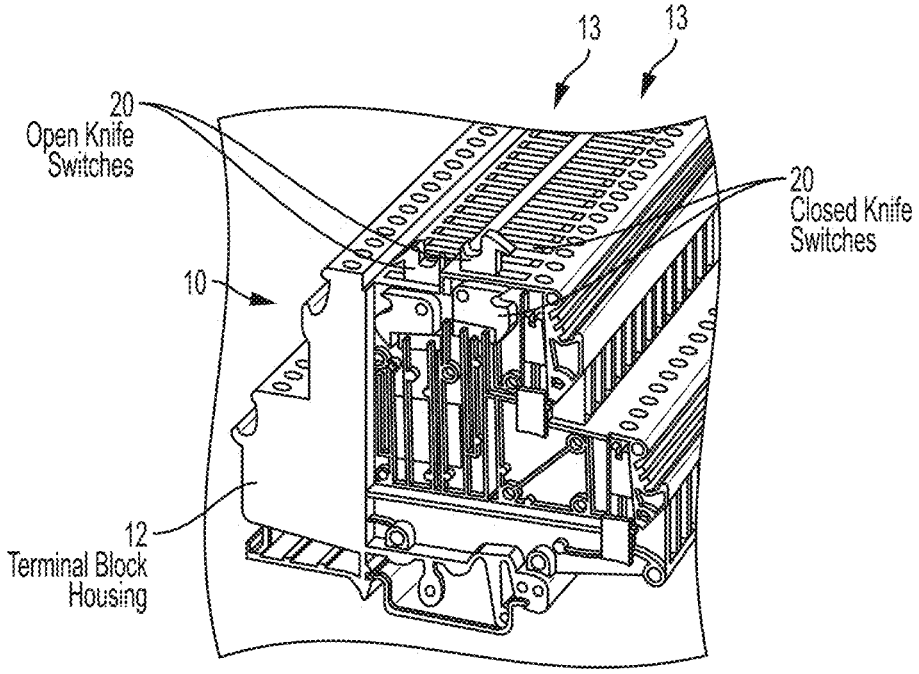
FIG. 2 is a photograph of a portion of a double stack terminal block.
Figure 3:
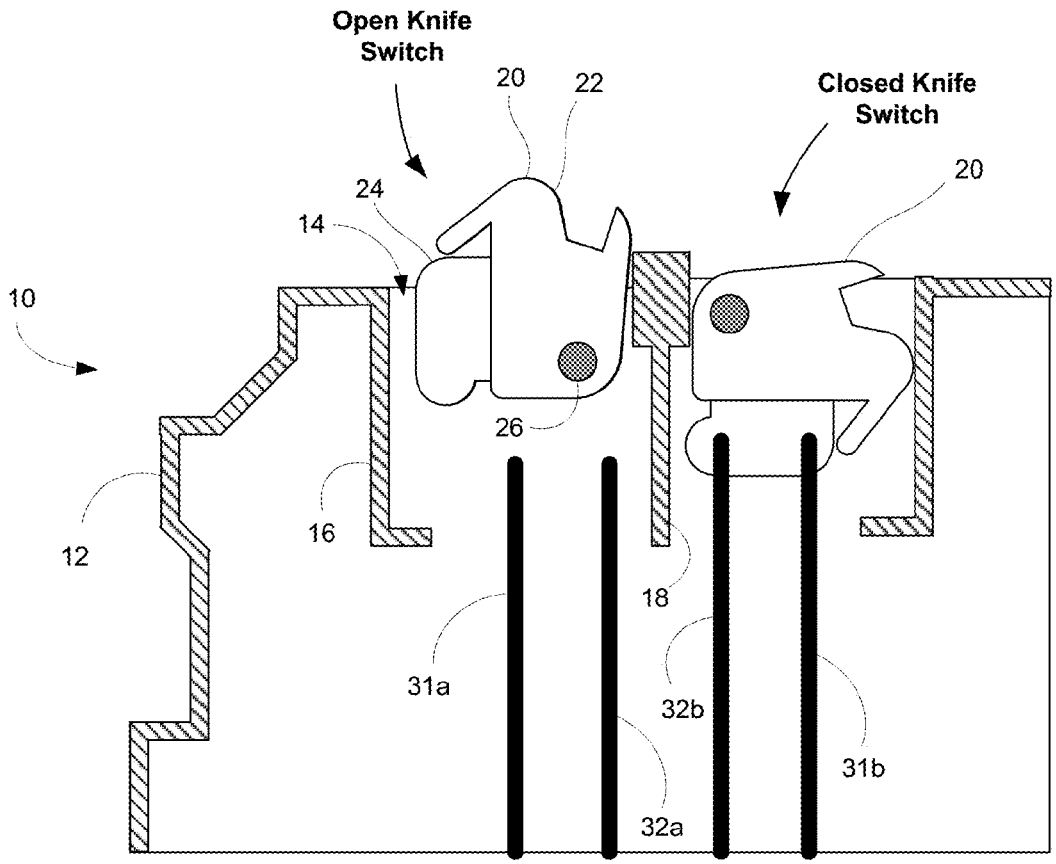
FIG. 3 is a cross-sectional view of a terminal block illustrating open and closed knife switches.

As noted above, some system configurations can make it very difficult to provide both lock-out and tag-out functions in a simple manner. FIGS. 1 and 2 show typical double stack disconnect terminal blocks 10 each comprising a pair of switch banks 13 with a plurality of knife switches 20 configured to make/break circuits in a large electrical system. FIG. 3 provides a schematic illustration of a section of a double stack terminal block 10 similar to those shown in FIGS. 1 and 2. The terminal block 10 has a housing 12 defining an internal space configured to accept a plurality of knife switches 20. Each knife switch 20 comprises a non-conductive body 22 and a conductive blade 24 and is configured for disposition within a well 14 defined in part by opposing internal walls 16 and 18 of the housing 12. Each switch 20 is rotatable about a pivot 26 between a closed configuration and an open configuration. In the closed configuration, the blade 24 engages two electrical contacts 31, 32 to provide electrical communication between the two as illustrated by 31*b* and 32*b*. When rotated to the open configuration, the blade 24 disengages from the two electrical contacts, thereby electrically isolating them from one another as illustrated by 31*a* and 32*a*.

While the bodies 22 of the knife switches 20 in FIGS. 1-3 provide some visual indication of an open circuit, their visibility is limited, particularly when they are part of a block with a large number of switches. Moreover, there is a significant potential of errant or inadvertent closure of these switches.

There is accordingly a need for a device that allows for positive lock-out of individual switches in a large block of multiple switches. Ideally, this device would also facilitate and enhance the tag-out functionality of such individual switches.

The present invention provides knife switch safety devices that provide a positive interference that prevents rotation of a knife switch from an open position to a closed position, thereby assuring isolation of field devices from a power source. The devices are easy to use and inexpensively constructed from readily available non-conductive materials. The following paragraphs describe two illustrative embodiments.

Figure 4A:
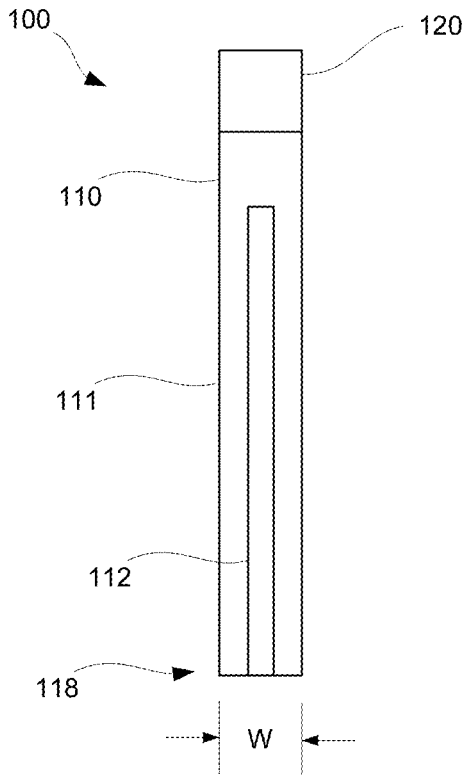
FIGS. 4*a* and 4*b* are front and side views, respectively, of a knife switch safety device according to an embodiment of the invention.
Figure 4B:
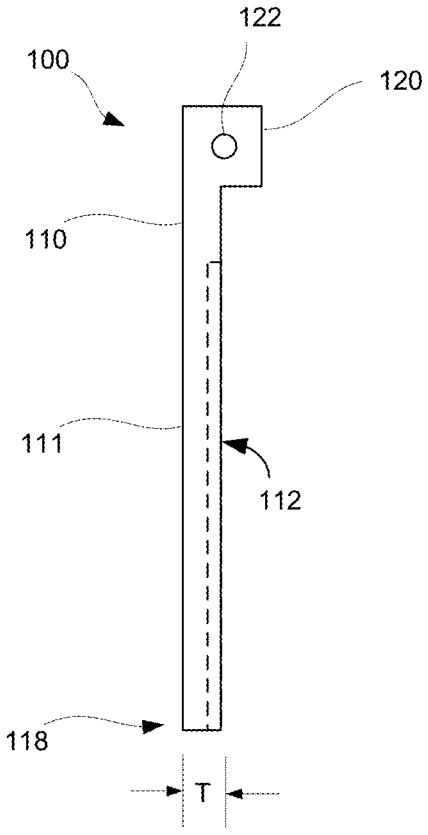
Figure 5:
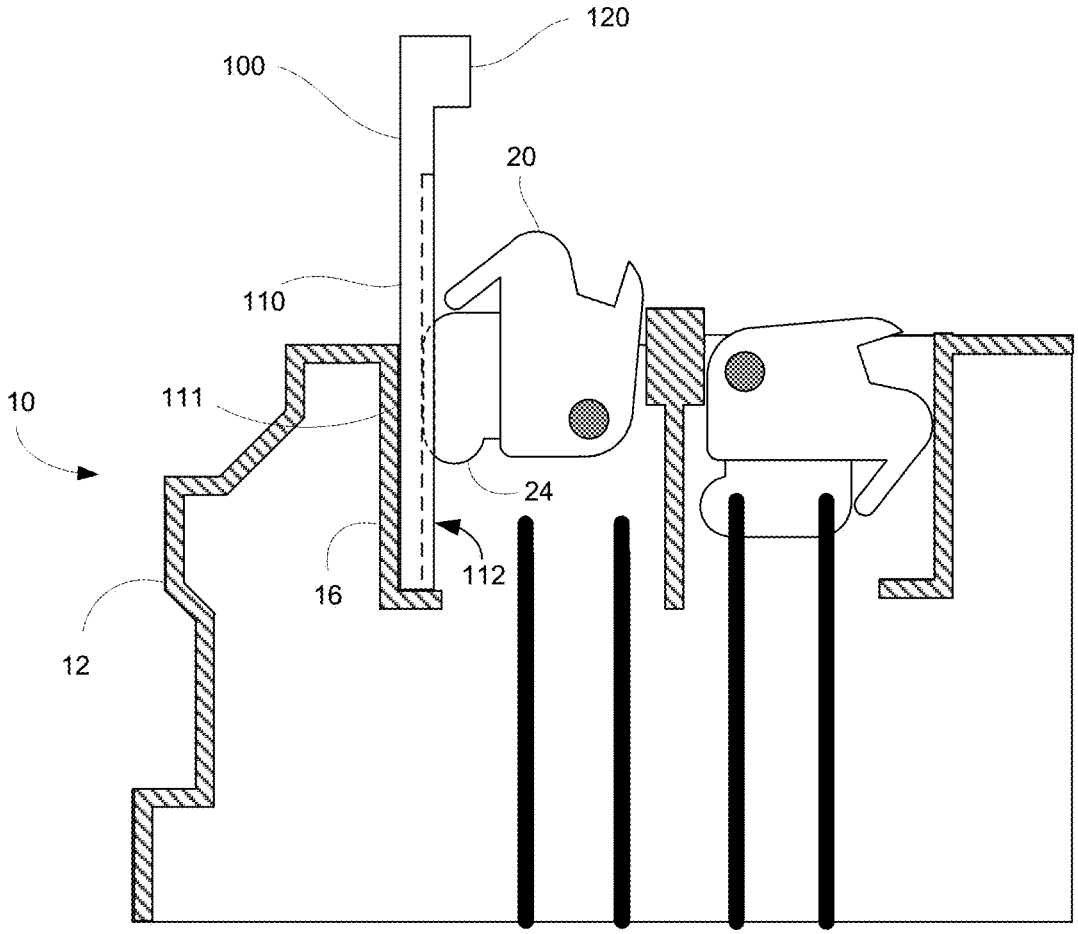
FIG. 5 is a side view of a knife switch safety device according to an embodiment of the invention installed in a terminal block.
Figure 6:
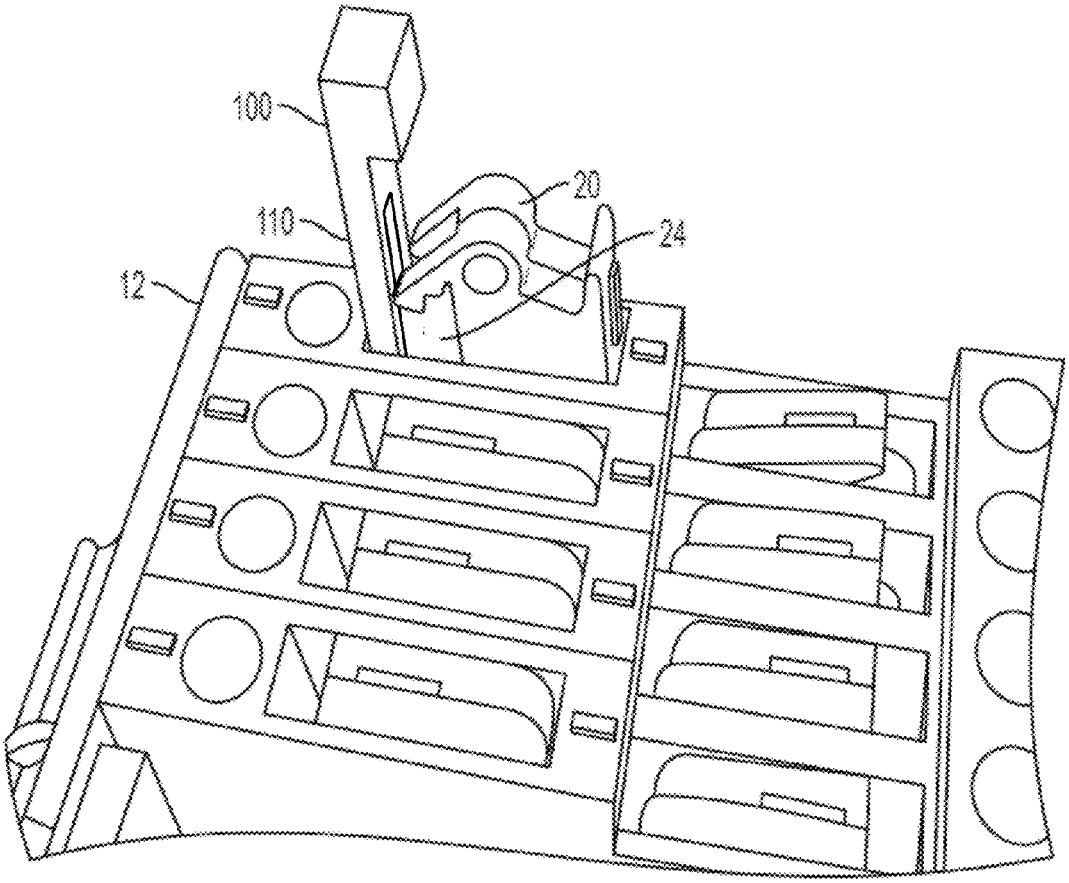
FIG. 6 is a photograph of a knife switch safety device according to an embodiment of the invention installed in a terminal block.

With reference to FIGS. 4-6, an exemplary knife switch safety device 100 has an elongate base member 110 with a head or tab portion 120 attached at one end. The base member 110 has an insertion portion 111 sized for insertion into the switch well of a knife switch terminal block housing 12 between the internal wall 16 and a knife switch 20 in its open configuration as shown in FIGS. 5 and 6. The insertion portion 111 may be configured with a rectangular cross-section as shown in FIGS. 4*a* and 4*b*. It will be understood, however, that other cross-sections may be used as well. The entire base member 110 may be formed with the same cross-section. In some embodiments, however, some or all of the insertion portion 111 may have a different cross-section from the remainder of the base member 110. In some embodiments, the insertion portion may be tapered so that either or both of its lateral width W and its thickness T are smaller at its distal end 118 than where it merges into the rest of the base member.

A slot or channel 112 formed in the insertion portion 111 is sized and configured for receiving the free edge of the switch blade 24. The depth of the slot 112 is established so that the blade 24 contacts the bottom of the slot. When positioned in this manner, the device 100 electrically isolates the blade 24 and prevents the knife switch 20 from rotating to its closed position. With the knife edge captured in the channel, the knife blade is prevented from moving diagonally to bypass the safety device 100 and close the circuit.

The head portion 120 may be configured to assist in the grasping and manipulation of the safety device 100. It may also be configured and/or sized to enhance the visibility of the device when installed, thereby enhancing its tag-out functionality. In the illustrated device 100, the head portion 120 is simply a rectangular block that has a larger, and thus more visible, lateral cross-section than the rest of the device 100. Any suitable size or shape may be used. In some embodiments, the head portion 120 may have a through hole configured for receiving a thread, cable, tether, clip or other form of connector for use in attaching a tag.

The safety device 100 may be any length that provides the required switch isolation and rotation blockage. In particular embodiments, the length may be established so that the free end of the insertion portion 111 "bottoms out" against the bottom of the well or against another internal structure while the head end 120 extends away from the top of the well by a desired distance. The length may also be established so that the device 100 may be used in switch wells having different depths.

In some embodiments of the safety device 100, the width W of the device (or at least the insertion portion 111) may be established so as to provide an interference fit with the lateral walls that define the switch well 14. This reduces the likelihood of inadvertent removal of the device 100 from the well 14.

Figure 7A:
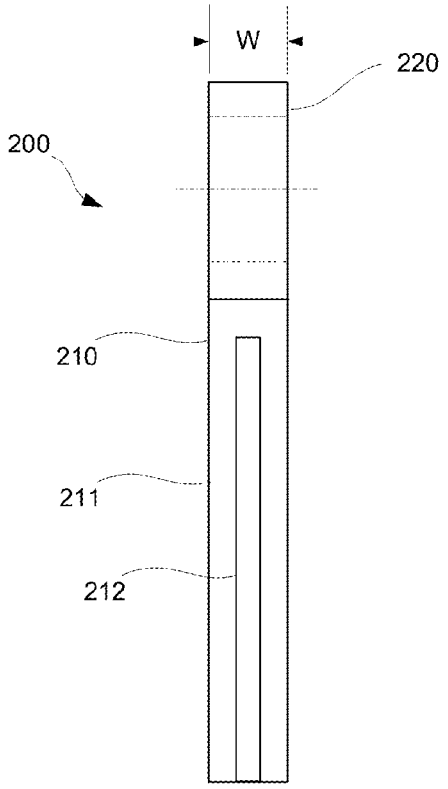
FIGS. 7*a* and 7*b* are front and side views, respectively, of a knife switch safety device according to an embodiment of the invention.
Figure 7B:
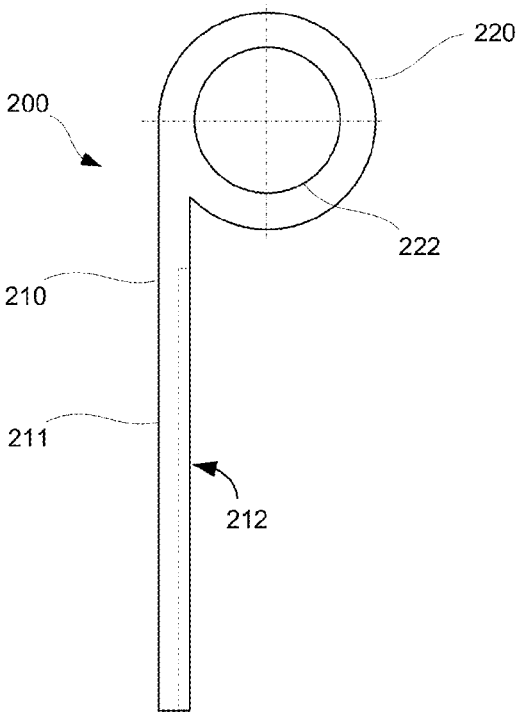
Figure 8:
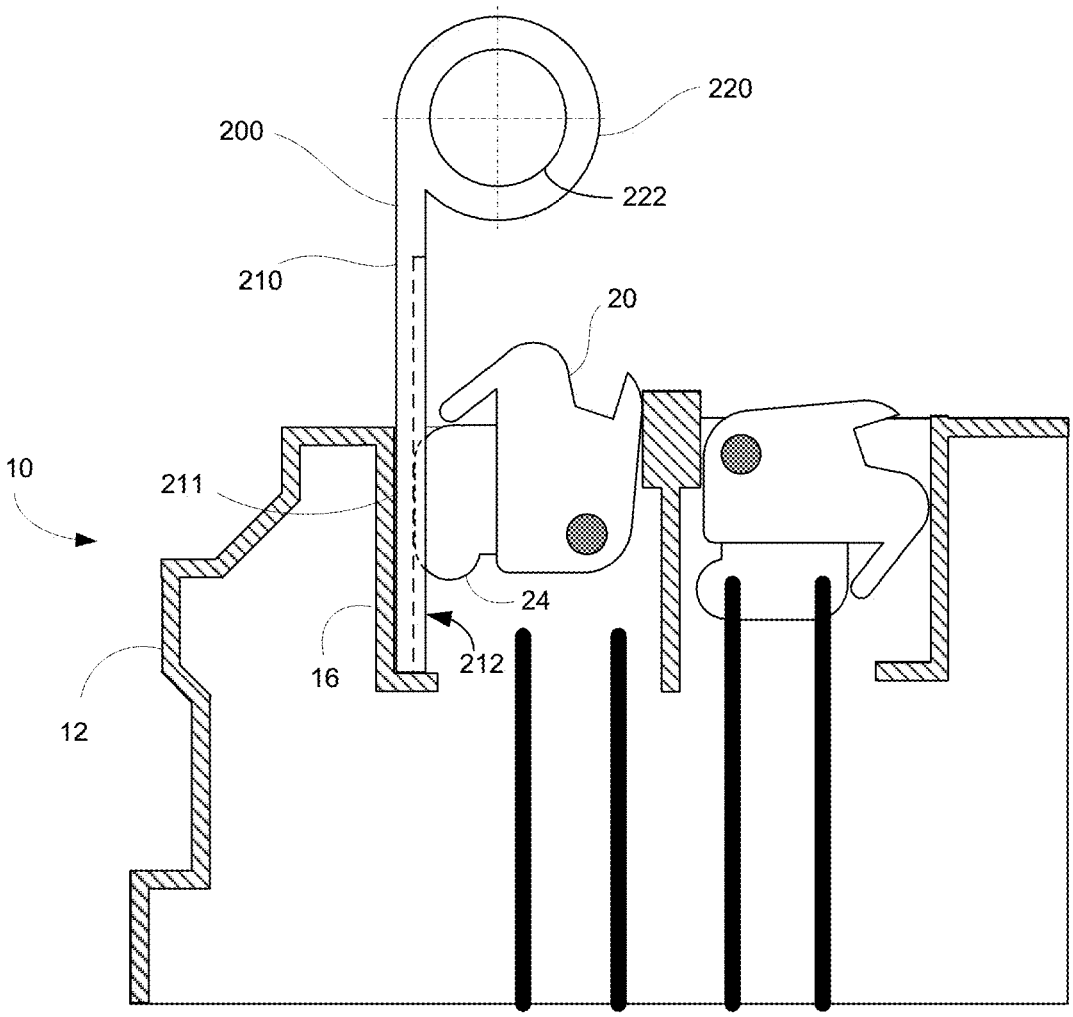
FIG. 8 is a side view of a knife switch safety device according to an embodiment of the invention installed in a terminal block.

With reference to FIGS. 7 and 8, another exemplary safety device 200 has a base member 210 with an insertion portion 211 and a slot 212 similar to the base member 110, insertion portion 111, and slot 112 of the device 100.

The safety device 200, however, has a head portion 220 formed as a ring with an opening 222. The ring allows for easy attachment of tags or other identification or warning indicia.

The safety devices of the invention may be formed as monolithic structures from any suitable non-conductive material that possesses dimensional stability. In some embodiments, the devices may be formed from injection molded polymer materials. Such materials, may include nylon, plastics, resins, fiber-reinforced composites, non-pliable natural or synthetic rubber, etc. The particular materials may be selected so as to provide sufficient rigidity to resist compression when a predetermined force is applied but pliable enough that it will not damage the knife switch if a high degree of closure force is applied to the switch.

Some or all of the safety device may be provided with a desired color (e.g., red) that enhances its visibility.

The procedure for using the safety devices of the invention is straightforward and requires no additional tools:

Identify the terminal block and switch to be opened.

Electrically isolate the circuit by rotating the knife switch.

Insert the insertion portion of the knife switch safety device into the switch well in the terminal block, ensuring that the knife switch blade is captured in the channel of the safety device and that the device is bottomed out within the terminal block.

Hang or attach any desired tag(s) as required by procedure.

The device can be readily removed by applying enough force to overcome the resistance due to any interference fit. Once the safety device is removed, the knife switch can be closed. The safety device can then be reused.

It will be readily understood by those persons skilled in the art that the present invention is susceptible to broad utility and application. Many embodiments and adaptations of the present invention other than those herein described, as well as many variations, modifications and equivalent arrangements, will be apparent from or reasonably suggested by the present invention and foregoing description thereof, without departing from the substance or scope of the invention.

What is claimed is:

1. A safety device for use in conjunction with a knife switch at least partially disposed in a switch well, the knife switch having a conductive blade and being rotatable between a closed configuration in which the blade engages an electrical contact in the switch well and an open configuration in which the blade is spaced apart from the electrical contact, the safety device comprising:

an elongate base member having a head end and an insertion portion extending distally away therefrom, the insertion portion being configured for at least partial insertion into the switch well between the knife switch and an internal wall of the switch well when the knife switch is in its open configuration and to prevent the knife switch from rotating back to the closed configuration when so inserted;

a slot formed in at least a portion of the insertion portion of the base member, the slot being sized and positioned to receive at least a portion of the blade when the knife switch is in its open configuration and the insertion portion is inserted into the switch well between the knife switch and the internal wall; and a head attached to the base member at its head end.

2. A safety device according to claim 1 wherein the base member and the head are integrally formed as a monolithic structure.

3. A safety device according to claim 1 wherein the base member and the head are formed from non-conductive material.

4. A safety device according to claim 3 wherein the non-conductive material is one of the set consisting of nylon and natural or synthetic rubber.

5. A safety device according to claim 3 wherein the non-conductive material is a fiber-reinforced composite.

6. A safety device according to claim 1 wherein the base member and the head are sized and configured so that when the insertion portion is inserted into the switch well between the knife switch and the internal wall, the head extends proximally outward from the switch well.

7. A safety device according to claim 1 wherein the insertion portion of the base member has a rectangular cross-section.

8. A safety device according to claim 1 wherein the insertion portion of the base member has a lateral width dimension selected to provide an interference fit between two laterally spaced walls within the switch well when the insertion portion is inserted into the switch well.

9. A safety device according to claim 1 wherein the head portion is sized and configured to facilitate manual grasping of the head portion.

10. A safety device according to claim 1 wherein the head portion comprises a through hole configured for receiving a tag connector.

11. A safety device according to claim 1 wherein the head portion comprises a through hole configured for receiving a portion of a tag connector.

12. A safety device according to claim 1 wherein the head portion is formed as an annular ring.

13. A method for using a safety device in conjunction with a knife switch at least partially disposed in a switch well having internal walls and a floor, the knife switch having a conductive blade and being rotatable between a closed configuration in which the blade engages an electrical contact in the switch well and an open configuration in which the blade is spaced apart from the electrical contact, the method comprising:

providing a safety device having an elongate base member having a head end and an insertion portion extending distally away therefrom, a slot formed in at least a portion of the insertion portion of the base member, and a head attached to the base member at its head end;

rotating the knife switch from the closed position to the open position;

inserting the base member insertion portion of the safety device into the switch well between the knife switch and an internal wall of the switch well so that the knife switch is prevented from rotating back to the closed configuration.

14. A method according to claim 13 wherein the action of inserting the base member insertion portion includes:

aligning the blade of the knife switch with the slot; and moving the insertion portion distally so that an edge portion of the blade is received into the slot as the insertion portion is inserted into the switch well.

15. A method according to claim 14 wherein the action of inserting the base member insertion portion further includes:

continuing to move the insertion portion distally until a distal end of the base member contacts the floor of the switch well.

16. A method according to claim 13 further comprising:

removing the base member insertion portion of the safety device from the switch well; and rotating the knife switch from the open configuration to the closed configuration.

17. A method according to claim 13 further comprising:

attaching a tag to the head end of the safety device.

18. A method according to claim 13 wherein the knife switch is one of a plurality of knife switches in a terminal block and the method further comprises:

identifying and distinguishing the knife switch from the other switches in the plurality of switches.

19. A safety device for use in conjunction with a knife switch at least partially disposed in a switch well, the knife switch having a conductive blade and being rotatable between a closed configuration in which the blade engages an electrical contact in the switch well and an open configuration in which the blade is spaced apart from the electrical contact, the safety device comprising:

an elongate base member having a head end and an insertion portion extending distally away therefrom, the insertion portion being configured for at least partial insertion into the switch well between the knife switch and an internal wall of the switch well when the knife switch is in its open configuration;

a slot formed in at least a portion of the insertion portion of the base member, the slot being sized and positioned to receive at least a portion of the blade when the knife switch is in its open configuration and the insertion portion is inserted into the switch well between the knife switch and the internal wall; and a head attached to the base member at its head end, wherein the insertion portion of the base member has a lateral width dimension selected to provide an interference fit between two laterally spaced walls within the switch well when the insertion portion is inserted into the switch well.

20. A method for using a safety device in conjunction with a knife switch at least partially disposed in a switch well having internal walls and a floor, the knife switch having a conductive blade and being rotatable between a closed configuration in which the blade engages an electrical contact in the switch well and an open configuration in which the blade is spaced apart from the electrical contact, the method comprising:

providing a safety device having an elongate base member having a head end and an insertion portion extending distally away therefrom, the insertion portion having a lateral width dimension selected to provide an interference fit between two laterally spaced walls within the switch well when the insertion portion is inserted into the switch well, a slot formed in at least a portion of the insertion portion of the base member, and a head attached to the base member at its head end;

rotating the knife switch from the closed position to the open position;

inserting the base member insertion portion of the safety device into the switch well between the two laterally spaced walls and between the knife switch and an internal wall of the switch well so that the knife switch is prevented from rotating back to the closed configuration.

* * * * *